US005134417A

United States Patent [19]

Thompson

[11] Patent Number: 5,134,417

[45] Date of Patent: Jul. 28, 1992

[54] PLURAL FREQUENCY MATRIX MULTIPLEXER

[75] Inventor: James D. Thompson, Manhattan Beach, Calif.

[73] Assignee: Hughes Aircraft Company, Los Angeles, Calif.

[21] Appl. No.: 556,160

[22] Filed: Jul. 23, 1990

[51] Int. Cl.[5] ..... H01Q 3/22

[52] U.S. Cl. ..... 342/375; 342/373; 370/69.1

[58] Field of Search ..... 370/69.1, 120, 75; 342/373, 375

[56] References Cited

U.S. PATENT DOCUMENTS 4,839,894 6/1989 Rudish et al. ..... 370/70
4,882,588 11/1989 Renshaw et al. ..... 342/373
4,980,692 12/1990 Rudish et al. ..... 343/778

*Primary Examiner*—Douglas W. Olms
*Assistant Examiner*—H. Kizou
*Attorney, Agent, or Firm*—Gordon R. Lindeen, III; Steven M. Mitchell; Wanda K. Denson-Low

[57] ABSTRACT

A multiplexer for the transmission of signals on different carrier frequencies includes a Butler matrix with a set of delay elements secured to output terminals of the matrix. Each of the delay elements differs from the other delay elements in that the delays imparted to signals by each of the elements differ by an integral number of delay units. The selection of frequency values is made in accordance with the increment in delay unit so as to develop incremental values of phase shift which compensate for phase shift introduced by the phase shift taper of a Butler matrix. This permits summation of signals from plural input ports of the matrix without the generation of intermodulation products among the various signal channels.

3 Claims, 4 Drawing Sheets

| | | MATRIX OUTPUTS | | | | PHASE TAPER |
|---|---|---|---|---|---|---|
| | | W | X | Y | Z | |
| INPUTS | A | -45 | -90 | -135 | -180 | -45 |
| | B | -135 | 0 | -225 | -90 | +135 |
| | C | -90 | -225 | 0 | -135 | -135 |
| | D | -180 | -135 | -90 | -45 | +45 |

| | | MULTIPLEXER OUTPUTS | | | | PHASE TAPER | FREQUENCY |
|---|---|---|---|---|---|---|---|
| | | WW | XX | YY | ZZ | | |
| INPUTS | A | -45 | Y-90 | 2Y-135 | 3Y-180 | Y-45 | $f_2$ |
| | B | -135 | Y-0 | 2Y-225 | 3Y-90 | Y+135 | $f_4$ |
| | C | -90 | Y-225 | 2Y-0 | 3Y-135 | Y-135 | $f_1$ |
| | D | -180 | Y-135 | 2Y-90 | 3Y-45 | Y+45 | $f_3$ |
| DELAY | | 0·T | 1·T | 2·T | 3·T | | |

PLURAL FREQUENCY MATRIX MULTIPLEXER

BACKGROUND OF THE INVENTION

This invention relates to multiplexers of microwave electromagnetic signals and, more particularly, to a composite structure of a Butler Matrix with quantized delay units for nulling phase tapers at each of a plurality of input frequency channels and providing a distribution of each of a plurality of input signals among a plurality of output ports while retaining a uniform distribution of signal amplitudes throughout the multiplexer.

Multiplexers are widely used in signal processing operations. One example of the use of a multiplexer is in a communication system such as a direct broadcast system employing a satellite carrying an array antenna positioned for transmitting a plurality of signals at different frequencies to a designated region of the earth. It is the practice, upon receipt of the signals at the satellite, to amplify each of the signals in a separate channel, after which the signals are combined into a single transmission line coupled to the input port of a power splitter. The power splitter divides the signal power evenly among a set of radiators of the antenna to form a beam of electromagnetic power which carries the signals to earth.

However, a problem arises in the use of the foregoing single channel coupled to the input of the power splitter. The summing of all the signals in the single channel produces intense electric and magnetic fields which are prone to nonlinear effects, such as may occur under intense field strength at the interfaces between waveguide flanges which join the waveguides of a microwave circuit. A nonlinear effect introduced upon the sum of a plurality of signals results in intermodulation products which corrupt the individual signals. As a result, signals communicated by presently available satellite communication systems may have less fidelity than is desired.

SUMMARY OF THE INVENTION

The aforementioned problem is overcome with a multiplexer that provides one fourth of the total power in each of four output lines instead of all of the power in a single output line. This and other advantages are provided by constructing a multiplexer for signals in different frequency bands, in accordance with the invention, by use of a Butler matrix plus a set of fixed values of delay inserted at output ports of the Butler matrix. Input ports of the Butler matrix serve as input ports of the multiplexer, with individual ones of the ports serving respective ones of the signal frequency bands. The fixed values of delay are provided by delay lines connected to output ports of the matrix, output ports of the delay lines serving as output ports of the multiplexer.

As is well known in the microwave art, a Butler matrix has the attributes of a power splitter in that the signal power applied to any one of the input ports of the matrix is divided evenly among the output ports of the matrix. In addition, the matrix provides a phase taper between the signals outputted at successive ports of the matrix in response to a signal inputted at any one of the input ports, the amount of the phase taper differing with each input port. The phase taper appears as a fixed increment in phase which is present in output signals from successive ones of the output ports. The same phase taper appears for all signals applied to a specific input port independently of the signal frequency, as long as the signal falls within the bandwidth of the matrix.

It is known also that a delay line introduces both a delay and a phase shift to a sinusoidal signal propagating through the delay line. The amount of phase shift is proportional to the signal frequency and to the amount of delay. By inserting a set of fixed increments of delay in the matrix output ports, there results fixed increments in phase shift between successive ones of the output ports for any specific value of signal frequency.

In accordance with the invention, quantized values of delay are employed to counteract the quantized values of phase shift associated with the phase tapers of the Butler matrix. The amounts of delay inserted at the output ports of the matrix differ by a fixed increment of delay between successive ones of the matrix output ports. The delay increment is set to compensate for the phase tapers of the Butler matrix for all signal frequencies of interest in the following manner.

First, it is noted that the desired phase-taper compensation can be obtained at a specific single value of signal frequency, this being the frequency of the signal fed to one of the input ports of the matrix. Secondly, it is noted that the Butler matrix introduces its phase tapers independently of frequency for all signals in the bandwidth of the matrix, while compensatory delays introduced by the delay lines vary directly with frequency. Therefore, the invention provides for phase-taper compensation at other values of signal frequency fed to other ones of the matrix input ports wherein the frequency is selected so that the delay elements provide the desired amount of phase compensation. A very useful feature of the invention is provided by the fact that the various phase increments in the set of phase tapers of a Butler matrix have values which can be compensated by use of signal frequencies which are spaced apart uniformly in the frequency spectrum. The multiplexer of the invention is applicable to the foregoing satellite antenna situation as well as to signal processing circuitry generally.

BRIEF DESCRIPTION OF THE DRAWING

The aforementioned aspects and other features of the invention are explained in the following description, taken in connection with the accompanying drawing wherein.

DETAILED DESCRIPTION

Figure 1:
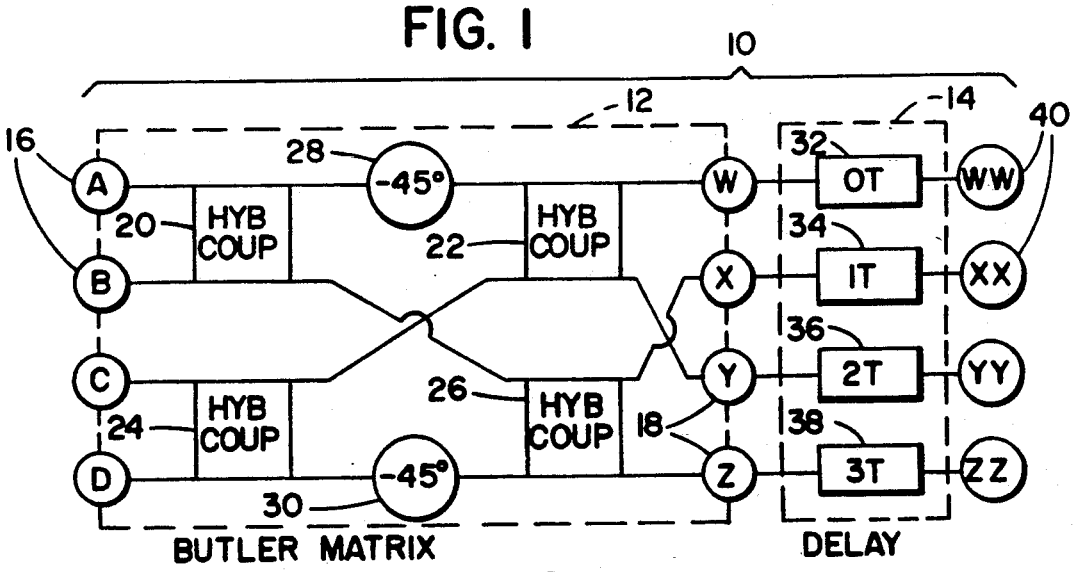
FIG. 1 is a diagram of a multiplexer constructed in accordance with the invention.

FIG. 1 shows a multiplexer 10 constructed in accordance with the invention, and including a Butler matrix 12 and a delay circuit 14. The matrix 12 is a well-known form of microwave circuit and, by way of example, is provided with four input ports 16 and four output ports 18. Individual ones of the input ports 16 are identified further by the legends A, B, C, and D. Individual ones of the output ports 18 are identified further by the legends W, X, Y, and Z. It is to be understood that the Butler matrix may be constructed with a larger number of input ports such as eight or sixteen input ports, with a corresponding number of output ports. The matrix 12, configured for four input ports as shown in FIG. 1, comprises four hybrid and 30. Each of the couplers 20–26 introduce a 90 degree phase shift and an equal division of power, 3 dB (decibels) coupling. Each of the phase shifters 28 and 30 introduce a phase lag of 45 degrees.

The delay circuit 14 is represented by four separate sections 32, 34, 36, and 38. Output ports 40 of the multiplexer 10 are connected via respective ones of the sections 32–38 to corresponding output ports 18 of the matrix 12. Individual ones of the output ports 40 are further identified by the legends WW, XX, YY, and ZZ. The delay section 32 is simply a straight-through connection introducing no delay (zero delay) between the ports W and WW. The delay section 34 introduces one unit of delay, T, between the ports X and XX. The delay sections 36 and 38 introduce respectively, two units of delay and three units delay between the respective pairs of ports to which they are connected.

In operation, the matrix 12 provides that a signal introduced at any one of the input ports 16 is divided evenly, in terms of its power, among all of the four output ports 18. In addition, the signals outputted at the set of output ports 18, in response to the presence of an input signal at any one of the input ports 16, have a phase taper, or progression in value, between successive ones of output ports 18, as will be described below with reference to FIGS. 3–5. The input signals at the respective input ports 16 are at different frequencies, there being four frequencies f1, f2, f3 and f4 for the four ports 16. The output port phase progressions are different for signals from each input port 16. In addition, the matrix 12 is reciprocal in its operation such that a set of signals having requisite phase taper, and applied concurrently to all of the four output ports 18, combine to provide a single signal at one of the input ports 16.

Figure 2:
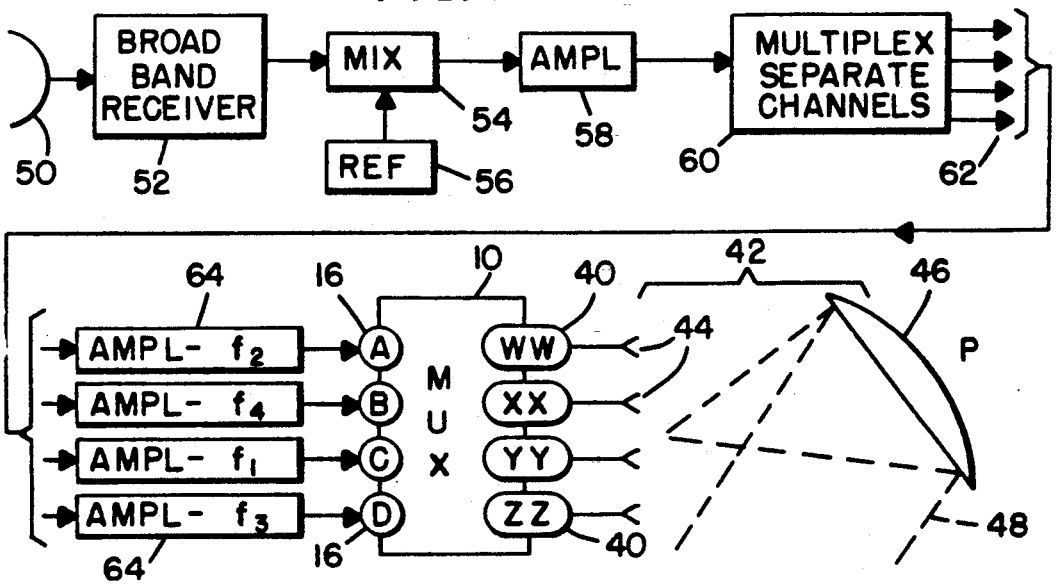
FIG. 2 shows diagrammatically, a system incorporating the multiplexer of the invention for generation of a beam of electromagnetic radiation.

As shown in FIG. 2, the multiplexer 10 may be used with a reflector antenna 42, by way of example, to combine signals of different frequencies applied to the input ports 16, and to distribute the resulting composite signal to a set of radiators 44. The radiators 44 are connected to the output ports 40 to operate as a feed array illuminating a reflector 46 of the antenna 42. Alternatively, the multiplexer 10 and the array of radiators 44 may operate without the reflector 46 as a direct radiating array (not shown). When operating with the reflector 46, the array of radiators 44 produces a component beam 48 covering a distinct angular region. The orientation of the component beam 48 is determined by the phase taper. There is a different phase taper and corresponding beam orientation for each of the four frequencies f1–f4. Since the multiplexer 10 provides a portion of the input signal at any one input port 16 to each radiator 44, there is a composite coverage beam resulting from input signals at the four frequencies, the composite coverage beam being a combination of the individual component beams 48.

For example, a satellite carrying the antenna 42 may generate component beams covering different geographic regions of the United States, and these component beams in summation form a composite beam covering all of the United States. In the absence of the reflector 46, the radiators 44 act as a direct radiating array where signals radiated from individual ones of the radiators 44 combine to form a single beam in one direction of point P, distant from the radiators 44. By virtue of the operation of the multiplexer 10 in dividing the power of each input signal at its respective input port 16 evenly among the output ports 40, the multiplexer 10 provides one fourth of the total power of each input signal in each of four output ports instead of all of the power in a single output line. Thus each output port 40 provides an output power which is the sum of contributions of power from each of the input signals. This feature of the multiplexer is advantageous in the operation of the satellite because four separate amplifiers connected to the four input terminals 16 can be employed to amplify the four input signals to generate the total output power without danger of developing intermodulation products, noted hereinabove, when all the signals are amplified together in a single channel of the prior communication systems.

The foregoing advantage in the use of the multiplexer 10 in a satellite is applicable generally to signal processing and to communication. For example, four separate signal sources operating at four different values of RF (radio frequency) may be coupled to the four input ports 16 to divide the powers of the four signals evenly among the four output ports 40, with each output port 40 outputting one quarter of the power of each input signal. Suitable signal combining means, such as the antenna 42, may be coupled electromagnetically to the output ports 40 for combining the components of the respective signals to produce combined output signal such as the foregoing component beams 48.

By way of example in the construction of the satellite, FIG. 2 provides further detail in the construction of circuitry of the satellite employing the multiplexer 10. The satellite may carry an up-link antenna 50 for receiving signals transmitted to the satellite from a station on the earth. The received up-link signals are at separate values of RF in a band centered at 17 GHz (gigahertz), by way of example. The signals are amplified by a broad band amplifier 52, and are applied to a mixer 54 in which the signals are down-converted, by mixing with an RF signal of a reference source 56, to a lower value of frequency, 12 GHz, for example. The signals are then coupled from the mixer 54 via an amplifier 58 to a multiplexer 60. The amplifier 58 provides further amplification of the signals, and the multiplexer 60 separates the signals into separate channels 62 of relatively narrow bandwidth. In accordance with the practice of the invention, the satellite circuitry further comprises a set of four amplifiers 64 which provide final amplification of the signals in their respective channels 62, and apply the signals to respective ones of the input ports 16 of the multiplexer 10. Thereupon, the signals are distributed among the four output multiplexer ports 40 to provide the aforementioned component beams 48. The use of the multiplexer 10 in conjunction with the sets of four amplifiers 64 enables the attainment of a desired output level power without danger of intermodulation inherent in a single amplification channel of the prior art.

Figures 3, 4, 5:
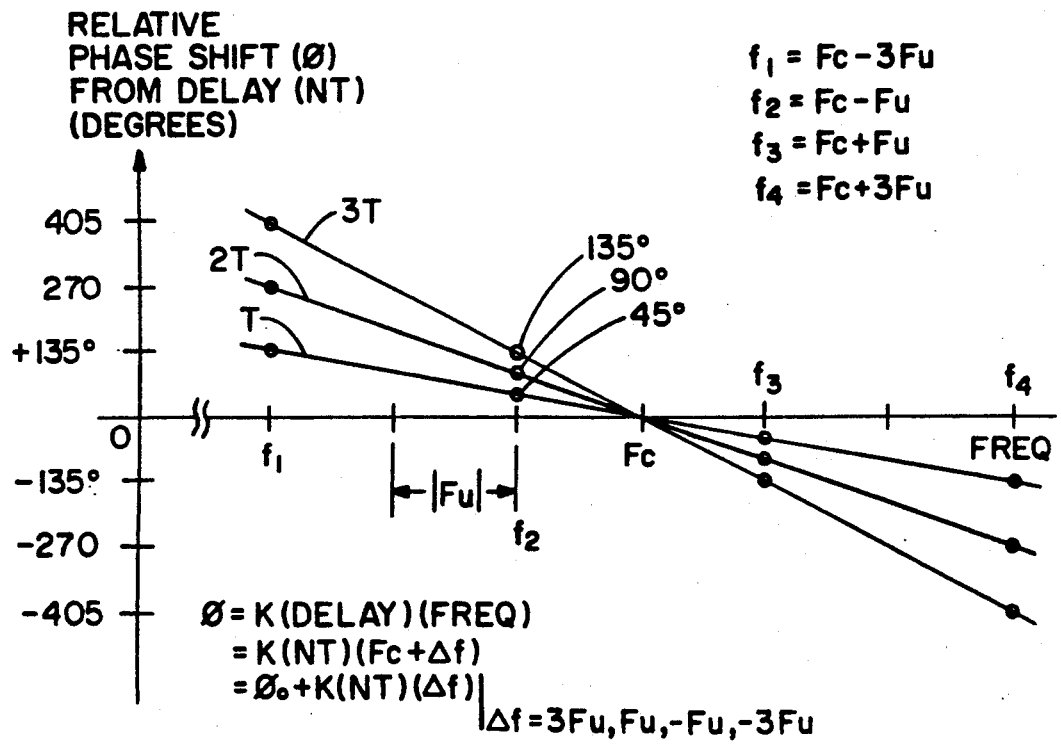
FIG. 3 is a chart showing phase shifts produced at various outputs of a Butler matrix, the matrix being a part of the multiplexer of FIG. 1.
FIG. 4 is a graph showing relative phase shift as a function of frequency for different values of delay employed at output terminals of the Butler matrix.
FIG. 5 is a chart showing phase shifts produced at various outputs of the multiplexer, and further showing values of frequency, the delay employed for compensating the multiplexer for phase tapers of the Butler matrix, and other parameters.
Figure 6A:
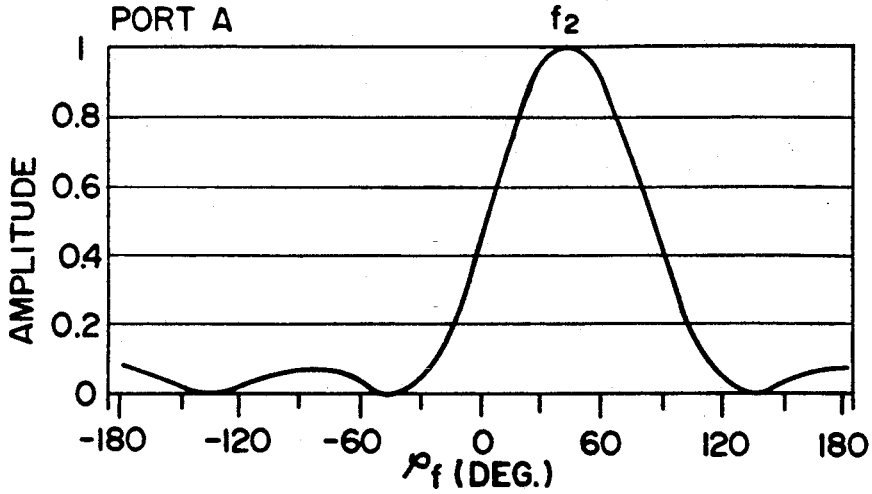
FIGS. 6A–6D show frequency spectra of different channels of the multiplexer.
Figure 6B:
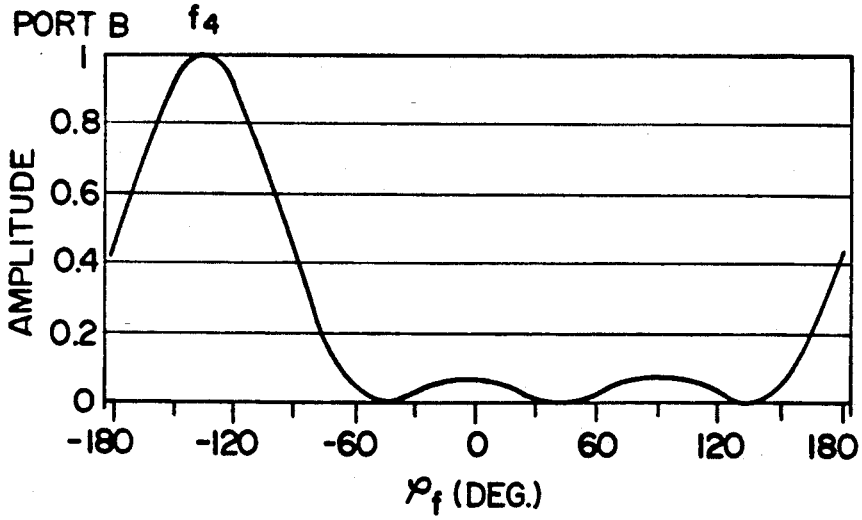
Figure 6C:
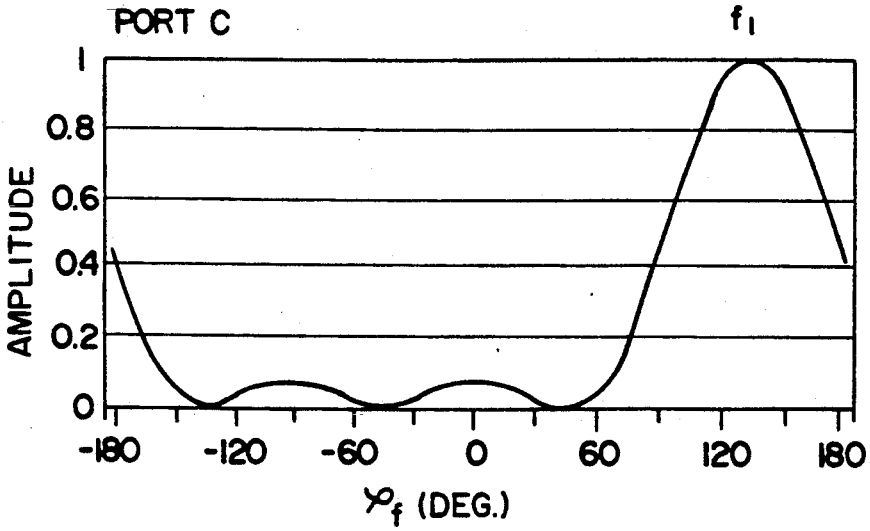
Figure 6D:
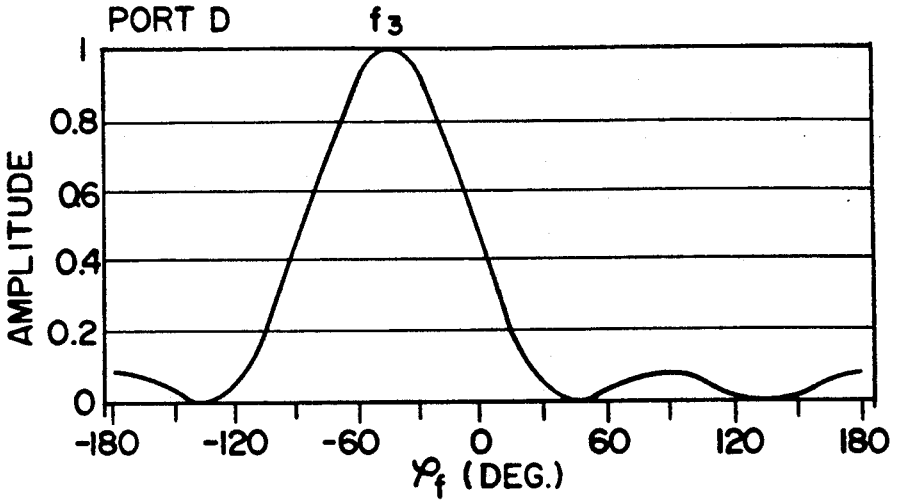

A chart in FIG. 3 shows the phase taper, and the actual values of phase shift, experienced by a signal at output ports W, X, Y, and Z of the matrix 12 in response to application of an input signal to any one of the input ports A, B, C, or D. In the chart, at the intersection of a column identified by the legend W, and a row identified by the legend A, there is shown a value of 45 degrees phase lag (represented by the minus sign) experienced by an electromagnetic wave traveling from the input port A to the output port W of the matrix 12. Similarly, at the intersection of the column identified by the legend X, and the row identified by the legend A, the chart presents a phase lag of minus 90 degrees which is present at the output port X in response to the presence of an input signal at port A. Similarly, the other intersection of the rows and columns of the chart show values of phase shift imparted to signals at various ones of the output ports 18 of the matrix 12 in response to signals applied to individual ones of the input ports 16 of the matrix 12. It is understood that the matrix 12 operates in a linear fashion, and that linear superposition of the signals is accomplished by the matrix 12 so that input signals can be applied concurrently at a plurality of the input ports 16 for generating, concurrently, sets of output signals at the set of output ports 18. The column on the right side of the chart provides the increment in phase between successive ones of the output ports 18, this being a phase taper of constant phase increment for the case of a signal inputted at any one of the input ports 16.

In accordance with the invention, it is desired to produce a multiplexer in which input signals applied to any one of a set of input ports are divided evenly in power among the output ports with equal phase. Thus, the multiplexer 10 of the invention operates, in response to the presence of an input signal at any one of the input ports 16, to provide an equal value of phase shift at each of the multiplexer output ports 40. The phase taper, or progression in values of phase among the ports 40 is zero. This objective of the invention is accomplished, as shown in FIGS. 1, 4, and 5, by the introduction of separate values of delay at the output ports 18 of the matrix 12, and by operation at different values of frequency for the carrier signals applied to each of the input ports 16 of the multiplexer 10.

FIG. 4 shows the desired phase shift versus frequency characteristics for the delay lines designated T, 2T, and 3T. As is well known, the application of a time delay to a sinusoidal signal has the effect of introducing a phase shift wherein the amount of time delay is equal to the negative of the derivative of phase shift with respect to frequency. Four frequencies are designated in FIG. 4, namely, the frequencies f1, f2, f3, and f4. These frequencies are symmetrically located about a center frequency Fc. Also shown in FIG. 4 are four equations defining each of the frequencies f1, f2, f3, and f4 in terms of the center frequency Fc and in terms of a number of unit increments of frequency, Fu. Thus, f1 has a value of frequency shown in the graph as being three units to the left of the center frequency Fc, and f4 is located at three units to the right of the center frequency Fc. The frequencies f2 and f3 are located, respectively, one unit to the left and one unit to the right of the center frequency.

In the graph, different traces are provided dependent on the amount of delay in the delay sections 32–38 (FIG. 1). In the case of the section 32, there is no delay and no phase shift associated therewith. In the section 34, there is one unit of delay, T, providing a straight line having a relatively small negative slope. Steeper slopes are shown for the traces representing the phase shifts imparted by the two units of delay for the section 36 and the three units of delay for the section 38. The corresponding traces of the graph are identified by the legends T, 2T and 3T, respectively for the delay sections 34, 36 and 38.

Also shown in FIG. 4 is an equation for the phase shift showing that the amount of phase shift is proportional to the amount of delay and the value of frequency. The letter N designates the number of units of delay in each section of the delay circuit 14. In the constant of proportionality, one nanosecond of delay provides 0.36 degrees of phase shift per megahertz of frequency. The equation for the phase shift shows that the frequency can be written in terms of the center frequency Fc plus a frequency increment $\Delta f$ equal to one or more of the unit frequencies Fu. The equation shows that the phase shift is equal to a fixed value of a shift $\phi_0$ which is independent of the frequency increment, plus a variable value of phase shift dependent on the value of the frequency increment.

Setting the fixed phase shift $\phi_0$ equal to zero yields the proper expression for the relative phase shift characteristics of sections 32 to 38. From the equation it can be noted that the phase shift at any frequency and the slope of the line are proportional to the number of units of delay present in the section. Thus, the trace for section 36 having two units of delay has twice the slope than the trace for section 34 and twice the phase shift at any frequency. Similarly, the trace for section 38 having these units of delay has three times the slope than the trace for section 34, and three times the phase shift at any frequency. The phase shift characteristic of section 34 having one delay may be designated as $\phi$ where the actual phase shift is a function of frequency. Similarly, the phase shift characteristics of sections 36 and 38 having two and three units of delay respectively, may be designated as 2 $\phi$ and 3$\phi$ respectively.

The chart in FIG. 5 shows the phase shift through the multiplexer from any of the four input ports 16 to any of the four output ports 40. The chart includes the phase shifts of the matrix 12 as well as the phase shifts of the delay sections 32–36. The bottom row of the chart indicates the relative delay associated with each of the output ports of the multiplexer. The phase taper column in the chart indicates the signal phase difference between adjacent output ports when the signal enters the multiplexer at an input port. For example, the signal phase difference between adjacent output ports is $\phi-45$ degrees for signals entering the multiplexer at input port A.

In accordance with the invention it is desired to have all the phase taper values equal to zero. For signals using input port A, the output port phase taper equals zero when f equals 45 degrees. FIG. 4 indicates that this condition is achievedwhen the frequency is equal to f2. The output port phase taper for signals using input port B equals zero when the frequency equals f4. Similarly, the output port phase tapers associated with input ports C and D equals zero when the frequency equals f1 and f3 respectively. These operating frequencies for the input ports are indicated in the right-most column of FIG. 5.

In accordance with the invention, the selection of operating frequency increment for each input port, and the introduction of the monotonically increasing set of delay values provided by the delay circuit 14 provide the requisite values of phase shift in sections 32–38 to cancel the phase taper of matrix 12. This may be noted by inspection of FIGS. 1, 3, 4, and 5.

Consider the situation of a signal applied to the input port A of the matrix 12 and the multiplexer 10. The resulting set of phase shifts experienced at each of the matrix output ports W–Z are shown in the first row of the chart of FIG. 3. The phase shifts increase by a phase lag in the amount of 45 degrees between successive ones of the ports. The compensating frequency, indicated in FIG. 5, is the frequency f2 which, as shown in FIG. 4, produces phase shifts of zero degrees for zero delay, 45 degrees for one unit of delay, 90 degrees for two units of delay, and 135 degrees for three units of delay. As shown in FIGS. 1 and 5, zero units of delay appear at the multiplexer output WW, this leaving the phase shift unchanged at a 45 degree phase lag. One unit of delay appears at the multiplexer output XX resulting in a phase advance of 45 degrees which reduces the phase lag of 90 degrees to a phase lag of 45 degrees. Similarly, the two units of delay at the multiplexer output YY and the three units of delay at the multiplexer output ZZ reduce the phase lag, respectively, by 90 degrees and 135 degrees to result in equal values of 45 degrees phase-lag.

The effect of the phase compensation for signals inputted at the port B can also be determined, in similar fashion, by inspection of FIGS. 1, 3, 4, and 5. FIG. 3 shows that the matrix phase taper for Port B (second row of the chart) is a phase lead having a value of 135 degrees. The compensating frequency is f4 as shown in the second row of FIG. 5. With reference to FIG. 4, f4 is seen to provide lagging values of phase shift in the amount of 135 degrees, 270 degrees, and 405 degrees by interposition of delays in the amounts, respectively, of one unit, two units, and three units of delay. Therefore, in the left hand column of FIG. 3 zero phase correction is applied to the matrix output port W, a correction of 135 degrees is applied to the matrix port X, with corrections of values of 270 and 405 degrees being applied to signals at the matrix ports Y and Z. This leaves a resultant phase shift of 135 degrees lag at each of the multiplexer output ports WW–ZZ upon application of a signal frequency of f4 to input port B. Similarly, it may be shown by inspection that application of signal frequencies f1 and f3, respectively to the input ports C and D provide the requisite compensation to cancel the matrix phase tapers, respectively, of 135 degrees lag and 45 degrees lead.

In addition, each of the signal channels can have its own separate amplifier without danger of high signal strength in any one section or branch of the multiplexer because it is the nature of a Butler matrix to distribute the signal power from any one input port uniformly among the various transmission lines coupling the input port to all of the output ports.

This can be appreciated by reviewing the signal path from the input port A, in FIG. 1, to each of the matrix output ports W–Z. At the hybrid coupler 20, the signal from port A subdivides into two equal portions. At the hybrid couplers 22 and 26, each of the signal portions again subdivide into signals of equal power to provide for one-quarter of the input power at each of the matrix output ports 18. In the presence of a concurrent transmission of a signal from input port B, it is noted that the signal from port B splits evenly at the first hybrid coupler 20 to provide two signals of equal amplitude which are present concurrently with the two signals from the input port A. Therefore, the total power in any one of the output transmission lines from the coupler 20 is equal to the average power from the signals inputted at the ports A and B. Similar comments apply to signals inputted at the ports C and D. The signals from the ports C and D, upon being split by the coupler 24, combine with the subdivided signals of the input ports A and B via the couplers 22 and 26. The signals in the transmission lines of the couplers 22 and 26, and particularly in the output transmission lines thereof, do not exceed the average of the four signals applied to the four input ports 16. Thereby, the invention provides that nowhere within the multiplexer 10 is there found an excessively large strength of signal which would induce passive nonlinear intermodulation effects between the signals of the various ports A–D.

From the foregoing operation of the invention, it is apparent that the multiplexer 10 is ideally suited for a satellite broadcast system in which a plurality of television channels at different carrier frequencies can be received at a satellite, separately amplified, and then rebroadcast back to the earth. The multiplexer, by removing the phase tapers, permits signals which have been applied to separate ones of the input ports 16 to be combined and distributed to the radiators 44.

The transmission lines and the components of the Butler matrix 12 are sufficiently wide band so as to accommodate the combined spectra of the signals of all of the input ports 16. Each section of the delay circuit 14 operates linearly, so that for several signals propagating through each delay section. Separate phase shifts are introduced in accordance with the frequencies of the respective signals.

A combination of Butler matrix 12 with delay circuit 14 can be regarded as a form of transversal filter in which the delay sections 32–38 (FIG. 1) in combination with a subsequent summing of output signals at point P (FIG. 2) via the antenna 42 introduce the frequency characteristic of the filter. For applications where an antenna is not used, the signal summing from the multiplexer output ports is easily achieved with a summing network made up of hybrid couplers. In either event the frequency response of the signal summing is shown by the following mathematical representation.

Output signals V, of the four multiplexer output ports WW–ZZ, as viewed at P in response to an input signal at input port A are given by:

$$V_{AWP} = 1/4 \cos(2\pi ft - 45^\circ)$$
$$V_{AXP} = 1/4 \cos(2\pi ft + \phi_f - 90^\circ)$$
$$V_{AYP} = 1/4 \cos(2\pi ft - 2\phi_f - 135^\circ)$$
$$V_{AZP} = 1/4 \cos(2\pi ft + 3\phi_f - 180^\circ)$$

where t is time, f is the carrier frequency, and $\phi_f$ is the frequency dependent phase shift produced by one unit of delay T. Adding the four signals gives the carrier modulated by an envelope function, $E_\phi$. The envelope function is given by $$E_{A\phi} = \left. \frac{\sin\left[4\left(\frac{\phi_f - 45^\circ}{2}\right)\right]}{4 \cdot \sin\left(\frac{\phi_f - 45^\circ}{2}\right)} \right|_{f=f2}$$

wherein the response peaks at the indicated frequency, f. Similar expressions are obtained for signals inputted at ports B, C, and D, namely:

$$E_{B\phi} = \left. \frac{\sin\left[4\left(\frac{\phi_f + 135^\circ}{2}\right)\right]}{4 \cdot \sin\left(\frac{\phi_f + 135^\circ}{2}\right)} \right|_{f=f4}$$

$$E_{C\phi} = \left. \frac{\sin\left[4\left(\frac{\phi_f - 135^\circ}{2}\right)\right]}{4 \cdot \sin\left(\frac{\phi_f - 135^\circ}{2}\right)} \right|_{f=f1}$$

$$E_{D\phi} = \left. \frac{\sin\left[4\left(\frac{\phi_f + 45^\circ}{2}\right)\right]}{4 \cdot \sin\left(\frac{\phi_f + 45^\circ}{2}\right)} \right|_{f=f3}$$

The filter response presented by the foregoing mathematics is set forth in the graphs of FIGS. 6A–6D which present amplitude versus phase shift, the latter being a function of frequency as was disclosed in FIG. 4. Thus, the responses of the multiplexer 10 to the various signal channels, at the respective carrier frequencies, are spaced apart in frequency.

Figure 8:
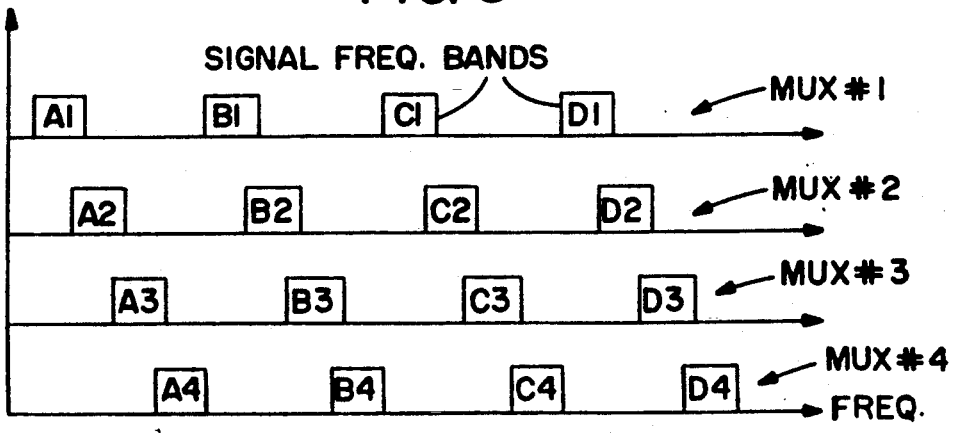
FIG. 8 shows a frequency assignment of channels for the system of FIG. 7.
Figure 7:
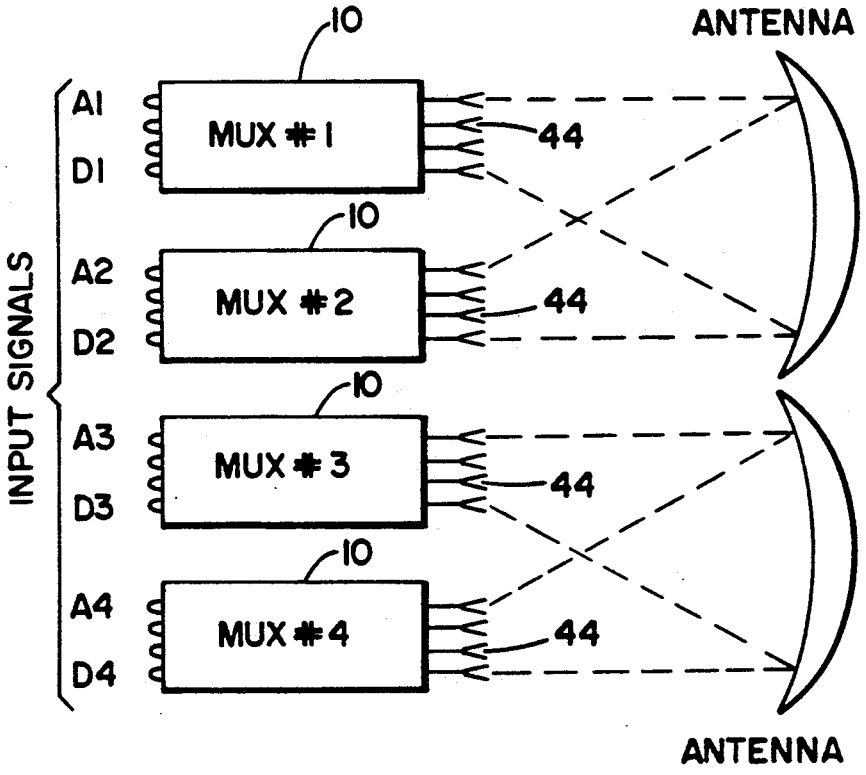
FIG. 7 shows a system of plural multiplexers with plural antennas.

The foregoing frequency spacing can be used to advantage in a communication system employing plural antennas and plural multiplexers with each of the antennas, as may be demonstrated in the sixteen-channel system of FIG. 7. Therein, a total of four multiplexers 10 are shown connected via arrays of radiators to two antennas. Television channels in adjacent frequency bands are applied to separate ones of the multiplexers so as to increase the spacing between frequency bands in any one of the multiplexers. The increased channel spacing within any one multiplexer improves fidelity in the concurrent transmission of the multiple television channels. The scheme of assignments of the channel frequencies for the system of FIG. 7 is shown in FIG. 8. The signals inputted to the ports A–D of the first multiplexer 10 are indicated by the legends A1, B1, C1 and D1. Similarly, the signals inputted to the second, the third and the fourth multiplexers are indicated by the legends, respectively, A2–D2, A3–D3, and A4–D4. In FIG. 8, the channel assignments of the four multiplexers are shown by four separate graphs drawn in registration with each other so that the frequencies of the respective channels can be compared. The frequency spacing between channels in any one multiplexer is shown to be much greater than the frequency spacing between adjacent channels.

Thereby, the invention has enabled the multiplexer to handle plural channels at relatively high amplitudes with reduced danger of development of passive intermodulation products. In addition, the multiplexer functions as a filter with clear definition between the frequency spectra of multiple signals to be carried by the multiplexer.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A method of communicating comprising:

establishing a plurality of multiplexers wherein each multiplexer provides for multiplexing a plurality of signals present respectively at a set of plural input terminals of the multiplexer to divide the power of each of said signals among a set of plural output terminals of the multiplexer, each of said multiplexers being constructed by the steps of:

providing a Butler matrix having a number of input ports arranged in a predetermined order and an equal number of output ports arranged in a predetermined order, the matrix providing a predetermined set of phase tapers among the output ports with different phase tapers being provided in response to a presence of an input signal at different ones of said input ports of the matrix;

connecting a set of delay lines in a predetermined order to the output ports of the matrix, each of said delay lines providing a different amount of delay to signals propagating through said output ports, the amounts of delay being quantized such that a first of said delay lines has a minimal amount of delay and that each succeeding delay line has a delay with one more quantum of delay than the delay of a preceding delay line, each of said delay lines establishing a phase shift to a signal propagating in the delay line with the phase shift being proportional to the frequency of the signal;

selecting a set of input signals of differing signal frequencies to be present at respective input ports of said matrix, the signal frequencies present at the respective matrix input ports differing from each other by an amount sufficient to establish a set of delay-line phase shifts which counteract the phase shifts in the respective phase tapers provided by the matrix; and wherein input ports of said matrix serve as input ports of said multiplexer, and output ports of said delay lines serve as output ports of said multiplexer;

said communicating method further comprising coupling output ports of a plurality of said multiplexers to radiating elements of an array antenna;

generating a beam of radiation by said antenna from signals of said plurality of multiplexers; and inputting signals to input ports of said multiplexers at different frequencies of a signal spectrum having a succession of frequency bands, separate frequency bands being applied to respective ones of said input ports, and wherein adjacent ones of said bands are applied to different ones of said multiplexers to maximize a spectral spacing of signals in channels of a multiplexer.

2. A method according to claim 1 wherein said step of generating a beam includes a generation of a plurality of beams for directing radiation from individual ones of said radiating elements to different geographical regions.

3. An apparatus for communicating comprising:

a plurality of multiplexers each having a set of plural input terminals and a set of plural output terminals wherein each multiplexer provides for multiplexing a plurality of signals present respectively at the set of plural input terminals of the multiplexer to divide the power of each of said signals among the set of plural output terminals of the multiplexer, each of said multiplexers comprising:

a Butler matrix having a number of input ports arranged in a predetermined order and an equal number of output ports arranged in a predetermined order, the matrix providing a predetermined set of phase tapers among the output ports with different phase tapers being provided in response to a presence of an input signal at different ones of said input ports of the matrix;

a set of delay lines connected in a predetermined order to the output ports of the matrix, each of said delay lines providing a different amount of delay to signals propagating through said output ports, the amounts of delay being quantized such that a first of said delay lines has a minimal amount of delay and that each succeeding delay line has a delay with one more quantum of delay than the delay of a preceding delay line, each of said delay lines establishing a phase shift to a signal propagating in the delay line with the phase shift being proportional to the frequency of the signal;

wherein input ports of said matrix serve as input ports of said multiplexer, and output ports of said delay lines serve as output ports of said multiplexer; and a plurality of radiating elements of an array antenna coupled to the output ports of a plurality of said multiplexers for generating a beam of radiation by said antenna from signals of said plurality of multiplexers;

so that inputting signals to input ports of said multiplexers at different selected frequencies of a signal spectrum having a succession of frequency bands, separate frequency bands being applied to respective ones of said input ports, establishes a set of delay line phase shifts which counteract the phase shifts in the respective phase taper provided by the matrix.

* * * * *